US006561436B1

(12) United States Patent
Boecking

(10) Patent No.: US 6,561,436 B1
(45) Date of Patent: May 13, 2003

(54) FUEL INJECTION VALVE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,967

(22) PCT Filed: Mar. 24, 1999

(86) PCT No.: PCT/DE99/00864

§ 371 (c)(1),
(2), (4) Date: Jul. 9, 2001

(87) PCT Pub. No.: WO00/17509

PCT Pub. Date: Mar. 30, 2000

(30) Foreign Application Priority Data

Sep. 23, 1998 (DE) ..... 198 43 535

(51) Int. Cl.[7] ..... B05B 1/08

(52) U.S. Cl. ..... 239/102.2; 239/90; 239/533.9; 123/498; 251/129.06

(58) Field of Search ..... 239/88–92, 102.1, 239/102.2, 533.2–533.12, 584; 123/498; 251/129.06

(56) References Cited

U.S. PATENT DOCUMENTS 3,995,813 A * 12/1976 Bart et al. ..... 239/584
4,022,166 A * 5/1977 Bart ..... 239/584
4,437,644 A * 3/1984 Wilmers ..... 239/584
5,280,773 A * 1/1994 Henkel ..... 251/129.06
5,482,213 A * 1/1996 Matsusaka et al. ..... 239/584
5,518,184 A * 5/1996 Potz et al. ..... 239/533.4
5,601,067 A * 2/1997 Wirbeleit et al. ..... 123/575
6,240,905 B1 * 6/2001 Boecking ..... 239/91

FOREIGN PATENT DOCUMENTS

| | | |
|---|---|---|
| DE | 43 06 073 | 6/1994 |
| DE | 43 06 072 | 9/1994 |
| DE | 195 00 706 | 7/1996 |
| DE | 197 02 066 | 7/1998 |
| JP | 09 324723 | 12/1997 |
| JP | 10 009084 | 1/1998 |

* cited by examiner

*Primary Examiner*—Michael Mar
*Assistant Examiner*—Dinh Q. Nguyen
(74) *Attorney, Agent, or Firm*—Kenyon & Kenyon

(57) ABSTRACT

A fuel injector (1), particularly an injection valve for fuel-injection systems of internal combustion engines, has a piezoelectric or magnetostrictive actuator (16). By way of a valve needle (5), the actuator (16) actuates a valve-closure member (4), which interacts with a valve-seat surface (7) to form a sealing seat. The actuator (16) has a tubular design, and encircles a transmission piston (19) that acts on a hydraulic transmission device (27).

11 Claims, 2 Drawing Sheets

FUEL INJECTION VALVE

BACKGROUND INFORMATION

The present invention is based on a fuel injector according to the species defined in claim 1.

A fuel injector according to the definition of the species in claim 1 is known from German Patent No. 195 00 706 A1. The fuel injector proceeding from this printed publication provides a piezoelectric actuator for actuating a valve needle connected to a valve-closure member. The valve-closure member interacts with a valve-seat surface to form a sealing seat. In this context, both the embodiment of a fuel injector opening to the outside and the embodiment of a fuel injector opening to the inside are possible. The piezoelectric actuator made of a plurality of stacked piezoelectric layers does generate relatively large lifting forces, but relatively small lift heights. Therefore, the named publication proposes providing a hydraulic transmission device between the valve needle and the piezoelectric actuator, in order to increase the lift transmitted to the valve needle.

A disadvantage of this known design of a fuel injector having a piezoelectric actuator is, that the relatively large volume and the relatively large cross-sectional area of the actuator does not allow one to realize an especially compact design. In addition, it is disadvantageous that a special hydraulic medium is used for the transmission device, which can volatize over time due to leakage. This can impair the functioning of the transmission device, and affect the service life of the fuel injector.

Another design of a fuel injector having a piezoelectric actuator is known from German Patent No. 43 06 073 C1. In this fuel injector, the movement of the piezoelectric actuator is transformed into the movement of the valve needle, using a hydraulic transmission device as well. This fuel injector also has the disadvantage of a relatively voluminous design that is not very compact, and the disadvantage of leaking hydraulic medium.

SUMMARY OF THE INVENTION

In contrast, the fuel injector according to the present invention, having the features of claim 1, has the advantage that the tubular form of the actuator, which at least sectionally encircles the valve needle or an actuating element for actuating the valve needle, achieves an especially compact and inexpensive design. The inner volume of the tubular, piezoelectric or magnetostrictive actuator can be used to receive component parts which, in the case of the known piezoelectric actuator, are situated in the axial extension of the piezoelectric actuator. Furthermore, tubular actuators can be manufactured relatively inexpensively. The fuel injector according to the present invention is especially suited for direct injection of gasoline into the combustion chamber of an internal combustion engine, since the fuel pressures occurring there lie in the range of approximately 100 to 200 bar and, relatively speaking, are markedly lower than those in diesel fuel injectors. Therefore, the actuating forces to be applied by the piezoelectric or magnetostrictive actuators in these direct gasoline-injection valves are also less than those in diesel fuel injectors, so that the actuating force for actuating these fuel injectors, which is conditional upon the tubular design, and reduced in comparison with an actuator made of solid material, is still perfectly sufficient.

Advantageous further refinements and improvements of the fuel injector indicated in the main claim are rendered possible by the measures specified in the dependent claims.

It is advantageous, when a hydraulic transmission device is provided between the valve needle and the actuator, and the actuator encircles a transmission piston acting on the transmission device. In order to connect it to the actuator, the transmission piston preferably has a flange, which is on the side opposite to the sealing seat, supports the actuator, and is preferably bonded to the actuator. The transmission piston can be integrated in the tubular actuator, which results in a compact design.

The actuator is preferably prestressed by a first prestressing spring, and the valve-closure member and the valve needle are reset by a restoring spring that is independent thereof If the fuel injector is a fuel injector that opens to the inside, it is advantageous when the transmission device reroutes the force between the transmission piston and the valve needle. Therefore, depending on the configuration of the transmission device, both fuel injectors opening to the outside and fuel injectors opening to the inside are feasible with the same general type of actuator construction. To divert the force for a fuel injector opening to the inside, the transmission device advantageously includes a housing member having an inner opening, in which the transmission piston can be moved. In this context, the housing member is enclosed a by the valve needle or a coupling piece, an inner chamber being formed between the transmission piston and the housing member, and an outer chamber being formed between the valve needle or coupling piece and the housing member, the inner chamber and the outer chamber being interconnected so as to communicate with each other. This forms an especially compact transmission device, which can be manufactured particularly inexpensively.

The fuel, which is conveyed in the fuel injector and is to be ejected by the fuel injector, is preferably used as a hydraulic medium for the transmission device. Therefore, the fuel injector must not be filled with a special hydraulic medium, e.g. a hydraulic oil, which can escape over time, due to leaking. Rather, fuel used as a hydraulic medium is automatically and continually refilled through guide openings, in a quasistatic manner.

BRIEF DESCRIPTION OF THE DRAWING

Exemplary embodiments of the present invention are depicted in simplified fashion in the drawings, and explained in more detail in the description below. The figures show.

DETAILED DESCRIPTION

Figure 1:
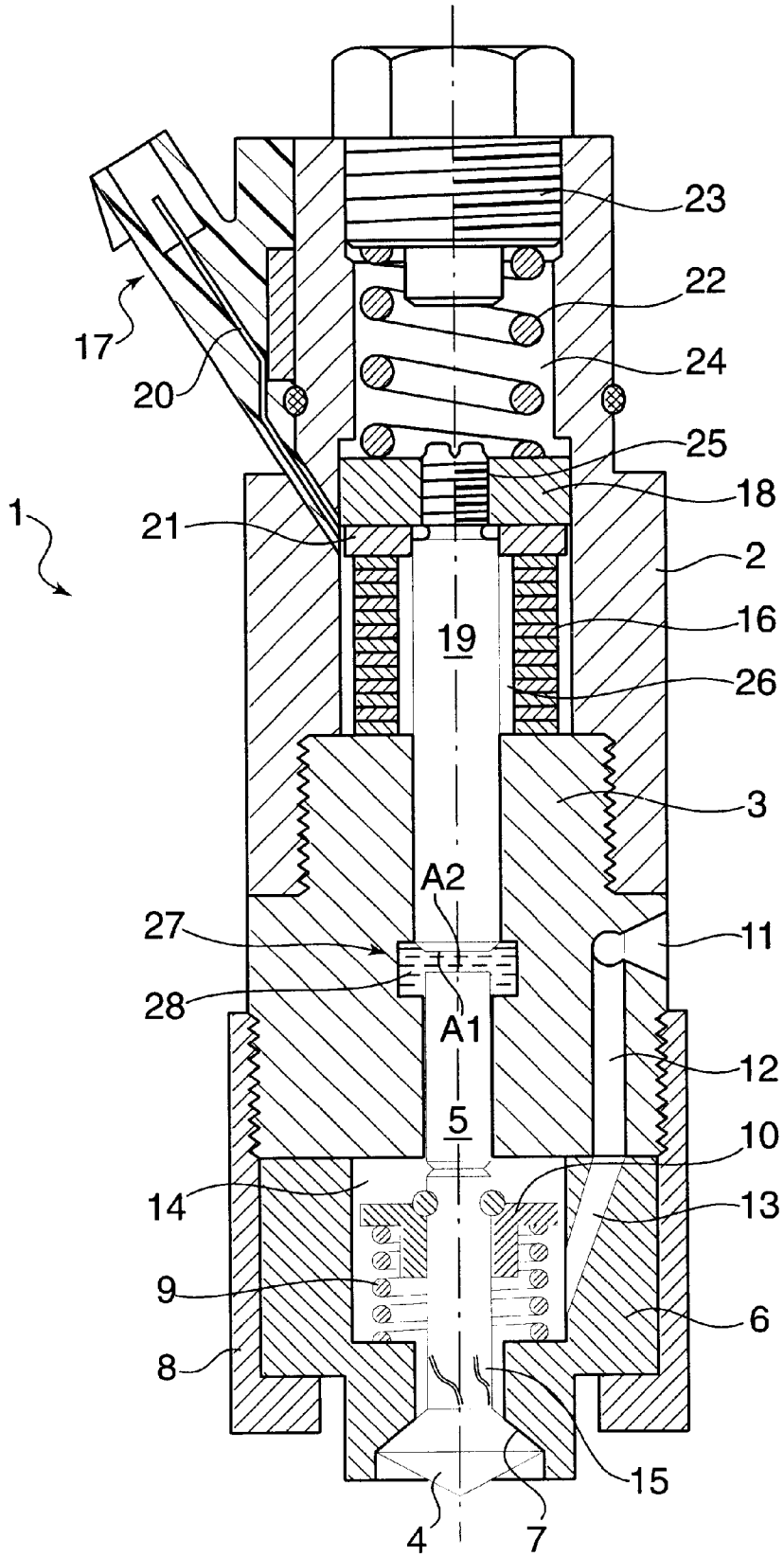
FIG. 1 an axial section through a first exemplary embodiment of a fuel injector according to the present invention.

FIG. 1 shows an axial sectional view of a first exemplary embodiment of fuel injector 1 according to the present invention. The fuel injector is particularly suitable for direct injection of fuel, especially gasoline, into a combustion chamber of a preferably mixture-compressing, spark ignition engine.

Fuel injector 1 has a housing, which is made of a first housing member 2 and a second housing member 3. In the exemplary embodiment, a valve-closure member 4 is formed in one piece with a valve needle 5, and interacts with a valve-seat surface 7 formed on a valve-seat support 6, to form a sealing seat. Valve-seat support 6 is clamped between a tightening nut 8 and second housing member 3. Valve-closure member 4 is prestressed against valve-seat surface 7, by restoring spring 9. For that purpose, a flange 10 on which restoring spring 9 rests is connected to valve needle 5.

The fuel to be ejected from fuel injector 1 flows in through fuel-intake nipple 11, and through a fuel line 12 provided in second housing member 3, and a subsequent, additional fuel line 13 provided in valve-seat support 6, into an opening 14 of valve-seat support 6. From opening 14, the fuel flows further through helical grooves 15, which are provided upstream from valve-closure member 4 and are used to distribute the fuel more effectively, to the sealing seat formed by valve-closure member 4 and valve-seat surface 7.

Valve needle 5 and valve-closure member 4 are actuated by a piezoelectric actuator 16, which has a tubular design according to the present invention. In the same manner, a magnetostrictive actuator can also be used in place of a piezoelectric actuator 16.

Piezoelectric actuator 16 is made of a plurality of piezoelectric, ceramic disks stacked on top of each other. Each of the ceramic disks are provided with electrodes, and an electrical voltage can be applied to them, via plug connector 17, in such a manner, that actuator 16 contracts in response to being actuated by the electrical voltage. Plug connector 17 can be extruded onto first housing member 2, as a plastic injection-molded part, and can be connected to actuator 16 by connecting line 20. Actuator 16 is clamped between second housing member 2 and a flange 18, and is prestressed by a compression spring 22, the exemplary embodiment providing for a spacer disk 21 being interposed. In the exemplary embodiment, the prestressing of compression spring 22 can be set by an adjusting screw 23. Actuator 16, spacer disk 21, flange 18, and compression spring 22 are situated inside longitudinal bore 24 of first housing member 2. Actuator 16 is preferably bonded to second housing member 3 and spacer disk 21.

A transmission piston 19 is preferably connected to flange 18 in an adjustable manner, via thread 25. Transmission piston 19 extends through an axial longitudinal opening 26 of tubularly designed actuator 16, to transmission device 27. The integration of transmission piston 16 into longitudinal opening 26 of actuator 16 results in an especially compact design of fuel injector 1, so that fuel injector 1, as a whole, only occupies a small volume.

Transmission device 27 includes a hydraulic chamber 28, which is filled with a hydraulic medium. In the exemplary embodiment, the hydraulic chamber is filled with fuel, which is lead through fuel-intake nipple 11 and fuel lines 12, 13. The end face of transmission piston 19 jutting into hydraulic chamber 28 has a surface A1, while the end face of valve needle 5 jutting into hydraulic chamber 28 has a surface A2. Surface A2 of valve needle 5 is smaller than surface A1 of transmission piston 19.

In response to actuator 16 being actuated, it contracts and transmits this movement, via flange 18, to transmission piston 19 which, in FIG. 1, is moved downward in the direction of valve-closure member 4. The consequently displaced volume of hydraulic medium in hydraulic chamber 28 shifts valve needle 5 downward in the direction of valve-closure member 4, the valve needle being in FIG. 1, as well. However, since surface A2 of valve needle 5 is smaller than surface A1 of transmission piston 19, the lift transmitted to valve needle 5 is greater the lift exerted by transmission piston 19. Valve-closure member 4 is lifted off valve-seat surface 7 and frees the sealing seat, so that fuel is ejected. To close fuel injector 1, the electrical voltage actuating piezoelectric/magnetostrictive actuator 16 is switched off, so that actuator 16 expands again, in opposition to compression spring 22. Valve needle 5 and valve-closure member 4, which is formed in one piece with the valve needle, are quickly reset by restoring spring 9.

The described fuel injector 1 achieves very short switching times, as are required, e.g. for directly injecting fuel into the combustion chamber of a mixture-compressing, internal combustion engine, especially a turbocharged engine.

It is particularly advantageous to use the fuel simultaneously as a hydraulic medium for transmission device 27. This ensures that hydraulic medium escaping through possible leaks is continually replenished. In the exemplary embodiment, the hydraulic medium is quasistatically refilled through a guide opening between valve needle 5 and second housing member 3, from a fuel reservoir formed in opening 14 of valve-seat support 16. In this context, it is important that the guide opening between valve needle 5 and second housing member 3 is dimensioned to be small enough that, in response to the actuation of the fuel injector and the resulting pressurization of hydraulic chamber 28, the hydraulic medium, i.e. the fuel, does not escape or only escapes negligibly through this guide opening.

Figure 2:
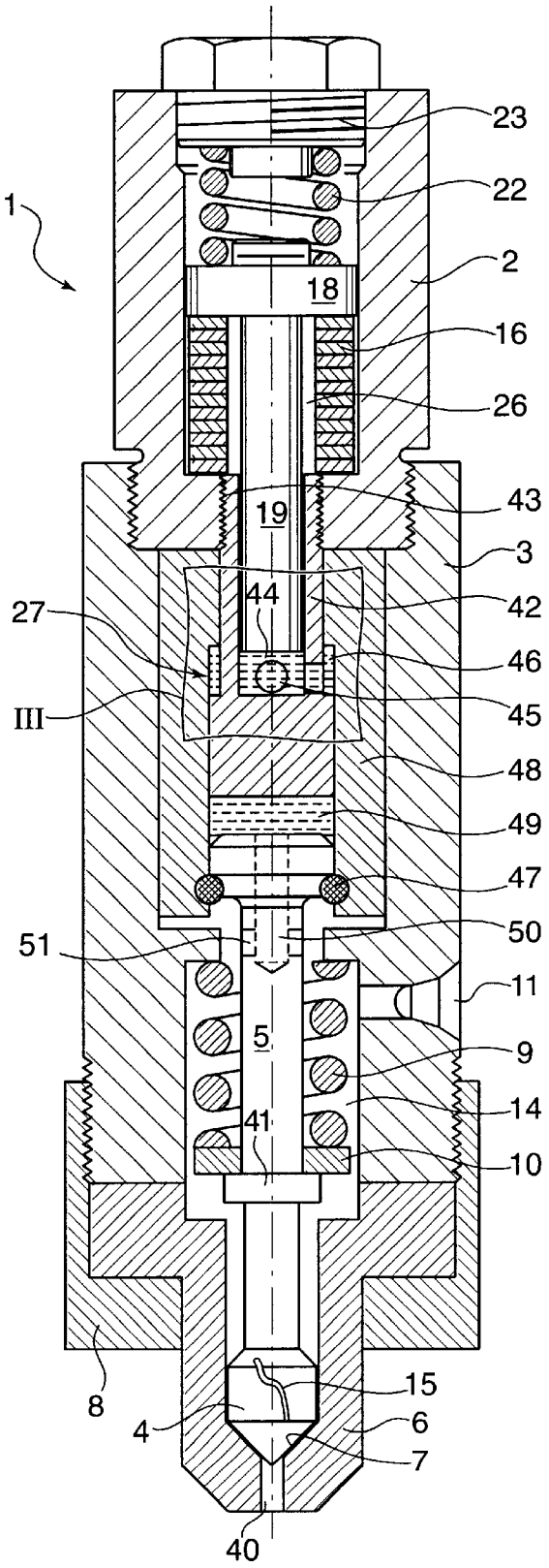
FIG. 2 an axial section through a second exemplary embodiment of a fuel injector according to the present invention.
Figure 3:
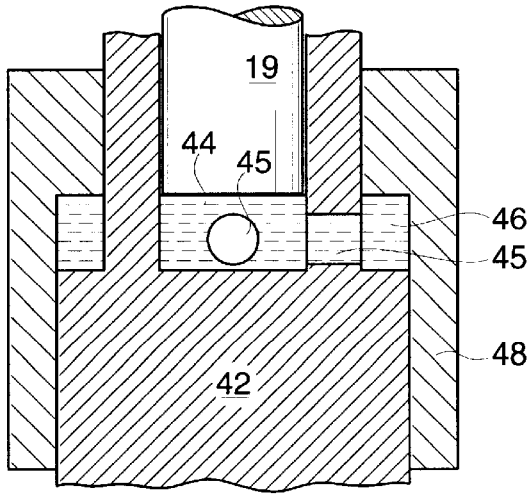
FIG. 3 an enlarged detail of section III in FIG. 2.

FIG. 2 shows a longitudinal section through a second exemplary embodiment of a fuel injector 1 according to the present invention, which is also preferably used for directly injecting fuel, especially gasoline, into the combustion chamber of a mixture-compressing, spark ignition engine. In this context, FIG. 3 shows section III in FIG. 2. Previously described elements are denoted by the same reference numerals, in order to facilitate their assignment. Consequently, a repeated description of them is not given.

While fuel injector 1 represented in FIG. 1 is a fuel injector 1 that opens to the outside, the fuel injector represented in FIG. 2 is a fuel injector 1 that opens to the inside. Therefore, valve-closure member 4 is situated on the inside with respect to valve-seat surface 7, and forms, together with valve-seat surface 7, a sealing seat, which seals a spray-discharge opening 40 in the closed position of fuel injector 1. Valve-closure member 4 and valve needle 5, which is formed in one piece with the valve-closure member, is prestressed by restoring spring 9. In the exemplary embodiment, restoring spring 9 is prestressed between second housing member 3 and a flange 10 lieing on a projecting rim 41 of valve needle 5.

Actuator 16, which, as in the exemplary embodiment represented in FIG. 1, also has a tubular design, is also penetrated by transmission piston 19, in the exemplary embodiment represented in FIG. 2.

Since, in response to applying an electrical actuating voltage, actuator 16 contracts and transmission piston 19 is therefore displaced downward, while, however, in order to open fuel injector 1, it is necessary to lift up valve needle 5 in FIG. 2, hydraulic transmission device 27 in this exemplary embodiment must divert the force. The design of transmission device 27, which is shown more clearly in FIG. 3, is used for this purpose. A third housing member 42 is screwed to first housing member 2, via thread 43, and is therefore rigidly fixed. Formed between third housing member 42 and transmission piston 19 is an inner chamber 44, which is connected to an outer chamber 46 by bore holes 45. Outer chamber 46 is formed between a coupling piece 48 and third housing member 3, the coupling piece encircling third housing member 42 and being rigidly connected to valve needle 5, by a welded seam 47.

When transmission piston 19 in FIG. 2 is displaced downward after the actuation of actuator 16, the volume in inner chamber 44 decreases, so that the hydraulic medium in inner chamber 44 is displaced through bore 45, into outer chamber 46, where it moves coupling piece 48 upward to increase the volume of outer chamber 46 in FIG. 2. This motion of coupling piece 48 is transmitted to valve needle 5, and therefore to valve-closure member 4, so that the sealing seat formed between valve-closure member 4 and valve-seat surface 7 is opened.

When the electrical actuating voltage is no longer applied to piezoelectric actuator 16, it expands again, in opposition to compression spring 22, and moves transmission piston 19 in FIG. 2 upward. Accordingly, valve needle 5 in FIG. 2 is moved down. This movement is aided by restoring spring 9, so that the closing time of fuel injector 1 is very short.

A filling chamber 49 is used to refill inner chamber 44 and outer chamber 46 of transmission device 27, the filling chamber being connected, via a longitudinal bore 50 and a transverse bore 51, to opening 14, which, in turn, is connected in fuel-intake nipple 11. Therefore, the filling chamber is filled with fuel in accordance with the prevailing inlet pressure at fuel-inlet nipple 11. Outer chamber 46 and inner chamber 44 of transmission device 27 are also refilled quasistatically, through a guide opening between coupling piece 48 and third housing member 42.

The present invention is not limited to the depicted exemplary embodiments, and can be realized for several other methods of constructing fuel injector 1.

What is claimed is:

1. A fuel injector, comprising:

one of a piezoelectric actuator and a magnetostrictive actuator including a tubular design;

a valve needle;

a valve-closure member capable of being actuated by the one of the piezoelectric actuator and the magnetostrictive actuator via the valve needle;

a valve seat surface with which the one of the piezoelectric actuator and the magnetostrictive actuator interacts to form a sealing seat;

a transmission device including a hydraulic medium and arranged between the valve needle and the one of the piezoelectric actuator and the magnetostrictive actuator; and a transmission piston acting on the transmission device as an actuating element, wherein:

the one of the piezoelectric actuator and the magnetostrictive actuator encircles the transmission piston, the fuel injector opens to an inside, the transmission device includes a structure such that a force between the transmission piston and the valve needle is rerouted, and the transmission piston and the valve needle move in opposite directions while the one of the piezoelectric actuator and the magnetostrictive actuator is actuated.

2. The fuel injector according to claim 1, wherein:

the fuel injector corresponds to an injection valve for a fuel-injection system of an internal combustion engine.

3. The fuel injector according to claim 1, wherein:

an end of the transmission piston facing away from the sealing seat includes a flange at which the one of the piezoelectric actuator and the magnetostrictive actuator is supported.

4. The fuel injector according to claim 3, further comprising:

a prestressing spring acting on the flange; and a restoring spring acting on the valve needle, wherein:

the one of the piezoelectric actuator and the magnetostrictive actuator is prestressed by the prestressing spring, and the valve-closure member is reset by the restoring spring.

5. The fuel injector according to claim 1, wherein:

the hydraulic medium includes a fuel conveyed in the fuel injector.

6. A fuel injector, comprising:

one of a piezoelectric actuator and a magnetostrictive actuator including a tubular design;

a valve needle;

a valve-closure member capable of being actuated by the one of the piezoelectric actuator and the magnetostrictive actuator via the valve needle;

a valve seat surface with which the one of the piezoelectric actuator and the magnetostrictive actuator interacts to form a sealing seat;

a transmission device including a hydraulic medium and arranged between the valve needle and the one of the piezoelectric actuator and the magnetostrictive actuator;

transmission piston acting on the transmission device as an actuating element; and a coupling piece connected to the valve needle, wherein:

i) the one of the piezoelectric actuator and the magnetostrictive actuator encircles the transmission piston, ii) the fuel injector opens to an inside, iii) the transmission device includes a structure such that a force between the transmission piston and the valve needle is rerouted, iv) the transmission piston and the valve needle move in opposite directions while the one of the piezoelectric actuator and the magnetostrictive actuator is actuated, v) the transmission device includes a housing member that has an inner opening in which the transmission piston is movable, vi) the housing member is encircled by one of the valve needle and the coupling piece, vii) an inner chamber is formed between the transmission piston and the housing member, and viii) an outer chamber connected to the inner chamber is formed between the housing member and one of the valve needle and the coupling piece.

7. The fuel injector according to claim 6, wherein an end of the transmission piston facing away from the sealing seat includes a flange at which the one of the piezoelectric actuator and the magnetostrictive actuator is supported.

8. The fuel injector according to claim 7, further comprising:

a prestressing spring acting on the flange; and a restoring spring acting on the valve needle, wherein the one of the piezoelectric actuator and the magnetostrictive actuator is prestressed by the prestressing spring, and the valve-closure member is reset by the restoring spring.

9. The fuel injector according to claim 6, wherein the hydraulic medium includes a fuel.

10. The fuel injector according to claim 9, wherein the hydraulic medium is at least partially replenished if a portion of the hydraulic medium escapes through at least one leak.

11. The fuel injector according to claim 6, further comprising:

a filling chamber for refilling the inner chamber and the outer chamber, the filling chamber being in fluid communication with the inner chamber and the outer chamber.

* * * * *

UNITED STATES PATENT AND TRADEMARK OFFICE

CERTIFICATE OF CORRECTION

PATENT NO. : 6,561,436 B1
DATED : May 13, 2003
INVENTOR(S) : Friedrich Boecking

It is certified that error appears in the above-identified patent and that said Letters Patent is hereby corrected as shown below:

Title page,
Item [57], ABSTRACT,
Lines 1-8, delete "(1), (16), (5), (16), (4), (7), (16), (19), (27)".

Column 1,
Lines 5 and 6, delete "The present invention is based on a fuel injector according to the species defined in claim 1".
Line 7, insert -- FIELD OF THE INVENTION
The present invention relates to a fuel injector

BACKGROUND INFORMATION

A fuel injector for fuel-injection systems of internal combustion engines, which is designed to have a piezoelectric actuator, described in U.S. Patent No. 4,022,166. The valve has a valve-closure member, which can be actuated by the actuator, via a valve needle, and interacts with a valve-seat surface to form a sealing seat. The actuator has a tubular design, and a transmission device having a hydraulic medium is provided between the actuator and the valve needle. In addition, the fuel injector has a transmission piston, which acts on the transmission device, as an actuating element, and is encircled by the actuator. The fuel injector is designed as a fuel injector that opens to the inside. In this context, the functioning method of the fuel injector is such that, in response to the actuator being energized, the transmission piston the valve needle always move equidirectionally. If the actuator is energized, then the transmission piston moves upward, and the pressure drop in the hydraulic transmission chamber consequently lifts the valve needle off the sealing seat, in the same movement direction --.

Lines 8 and 9, delete "according to the definition of the species in claim 1".
Line 9, change "known from German Patent No. 195 00 706 Al." to -- described in German Published Patent Application No. 195 00 706. --.
Line 33, change "known from German Patent No. 43 06 073 Cl." to -- described in German Patent No. 43 06 073. --.
Delete lines 65 to 67.

Column 2,
Line 37, change "must not be" to -- is not to be --.
Line 42, change "...DRAWING" to -- ...DRAWINGS --.
Delete lines 44 to 46.
Line 47, change "FIG. 1 an" to -- FIG. 1 shows an --.
Line 49, change "FIG. 2 an" to -- FIG. 2 shows an --.
Line 52, change "FIG. 3 an" to -- FIG. 3 shows an --.

UNITED STATES PATENT AND TRADEMARK OFFICE

CERTIFICATE OF CORRECTION

PATENT NO. : 6,561,436 B1
DATED : May 13, 2003
INVENTOR(S) : Friedrich Boecking

It is certified that error appears in the above-identified patent and that said Letters Patent is hereby corrected as shown below:

Column 4,
Line 44, change "lieing" to -- which lies --.
Line 53, delete "it is necessary to lift up".
Line 53, change "needle 5" to -- needle 5 is lifted up --.
Line 55, change "must divert" to -- diverts --.

Signed and Sealed this

Thirtieth Day of May, 2006

JON W. DUDAS
*Director of the United States Patent and Trademark Office*